US011788545B2

(12) United States Patent
Umeyama et al.

(10) Patent No.: US 11,788,545 B2
(45) Date of Patent: Oct. 17, 2023

(54) CENTRIFUGAL COMPRESSOR

(71) Applicant: KABUSHIKI KAISHA TOYOTA JIDOSHOKKI, Kariya (JP)

(72) Inventors: Ryo Umeyama, Kariya (JP); Yoshiyuki Nakane, Kariya (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 17/482,727

(22) Filed: Sep. 23, 2021

(65) Prior Publication Data

US 2022/0099104 A1 Mar. 31, 2022

(30) Foreign Application Priority Data

Sep. 30, 2020 (JP) ..... 2020-164959

(51) Int. Cl.
*F04D 29/28* (2006.01)
*F04D 17/10* (2006.01)
*F04D 29/30* (2006.01)

(52) U.S. Cl.
CPC ..... *F04D 29/284* (2013.01); *F04D 17/10* (2013.01); *F04D 29/30* (2013.01)

(58) Field of Classification Search
CPC ..... F04D 29/284; F04D 17/10; F04D 29/30
USPC ..... 415/182.1
See application file for complete search history.

(56) References Cited

U.S. PATENT DOCUMENTS 1,871,747 A * 8/1932 Schlachter ..... F04D 29/2266 415/106
2,620,123 A 12/1952 Parducci et al.
2,658,455 A * 11/1953 Seinfeld ..... F04D 29/2266 415/106
3,213,794 A * 10/1965 Adams ..... F04C 19/00 417/69
3,944,406 A * 3/1976 Jagusch ..... F04D 9/003 416/186 A
4,890,980 A * 1/1990 Heald ..... F04D 29/2277 416/183
4,921,400 A * 5/1990 Niskanen ..... F04D 9/003 96/213
4,981,413 A * 1/1991 Elonen ..... F04D 9/003 415/115

(Continued)

FOREIGN PATENT DOCUMENTS

CN 108700085 A 10/2018
JP 2009-133267 A 6/2009

(Continued)

*Primary Examiner* — Hung Q Nguyen
*Assistant Examiner* — Anthony Donald Taylor, Jr.
(74) *Attorney, Agent, or Firm* — Sughrue Mion, PLLC

(57) ABSTRACT

A centrifugal compressor comprises an impeller including a hub and a plurality of blades. Each blade has a positive pressure surface and a negative pressure surface extending from one side of an external radial surface toward the other side of the external radial surface and being of a positive pressure and a negative pressure, respectively, when the impeller rotates. The hub has a lightening hole that opens to the external radial surface between the positive pressure surface and the negative pressure surface of the plurality of blades. The lightening hole is provided closer to the positive pressure surface of the blade than the negative pressure surface of the blade.

3 Claims, 3 Drawing Sheets

(56) References Cited

U.S. PATENT DOCUMENTS 5,019,136 A * 5/1991 Elonen ..... F04D 29/428 415/168.1
5,106,263 A * 4/1992 Irie ..... F04D 29/2255 415/206
5,116,198 A * 5/1992 Vesala ..... F04D 7/045 415/143
5,156,522 A * 10/1992 Tessier ..... F04D 29/445 415/58.4
5,167,678 A * 12/1992 Elonen ..... F04D 29/428 96/214
5,224,821 A * 7/1993 Ozawa ..... F04D 29/2222 416/223 R
5,542,817 A * 8/1996 Brandt ..... F04D 29/2288 415/106
5,628,616 A * 5/1997 Lee ..... F04D 29/2288 415/199.1
6,893,207 B2 * 5/2005 Kao ..... F04D 29/2288 415/58.2
7,175,384 B2 * 2/2007 Algers ..... F04D 29/2266 415/171.1
8,221,070 B2 * 7/2012 Baryshnikov ..... F04D 29/2266 415/206
9,951,786 B2 * 4/2018 Elebiary ..... F04D 29/2266
2006/0263200 A1 * 11/2006 Ahlroth ..... F04D 29/2266 415/58.2
2015/0354359 A1 * 12/2015 Matsuda ..... F04D 25/024 29/889.21
2016/0363134 A1 12/2016 Seike et al.
2019/0048878 A1 2/2019 Akimoto

FOREIGN PATENT DOCUMENTS

JP 2009133267 A * 6/2009 ..... F04D 29/28
JP 2018-168707 A 11/2018
JP 2018168707 A * 11/2018 ..... F04D 29/051

* cited by examiner

CENTRIFUGAL COMPRESSOR

This nonprovisional application is based on Japanese Patent Application No. 2020-164959 filed on Sep. 30, 2020 with the Japan Patent Office, the entire contents of which are hereby incorporated by reference.

BACKGROUND OF THE INVENTION

Field of the Invention

The present invention relates to a centrifugal compressor.

Description of the Background Art

For example, Japanese Patent Laid-Open No. 2009-133267 discloses a centrifugal compressor including an impeller. The impeller in the centrifugal compressor has a hub having an external radial surface and a back surface, and a plurality of blades. The hub is provided with a through hole formed therethrough between the external radial surface and the back surface. The through hole reduces the impeller's moment of inertia.

SUMMARY OF THE INVENTION

The centrifugal compressor described in Japanese Patent Laid-Open No. 2009-133267 has room for improvement in distribution of stress generated in the hub when the impeller rotates.

An object of the present invention is to provide a centrifugal compressor that can coestablish reduction in moment of inertia of an impeller and suppression of uneven distribution of stress caused to a hub.

A centrifugal compressor according to an aspect of the present invention is a centrifugal compressor comprising a rotation shaft and an impeller fixed to the rotation shaft and rotating together with the rotation shaft, the impeller including a hub having an external radial surface having a shape gradually increasing in diameter from one side of the rotation shaft toward the other side of the rotation shaft and a back surface formed on the other side of the rotation shaft, and a plurality of blades provided on the external radial surface of the hub, the plurality of blades each having a positive pressure surface and a negative pressure surface extending from one side of the external radial surface toward the other side of the external radial surface, and being of a positive pressure and a negative pressure, respectively, when the impeller rotates, the hub having a lightening hole that opens to the external radial surface between the positive pressure surface and the negative pressure surface, the lightening hole being closer to the positive pressure surface of the blade than the negative pressure surface of the blade.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention will now be described with reference to the drawings. In the figures referred to below, any identical or equivalent member is identically denoted.

Figure 1:
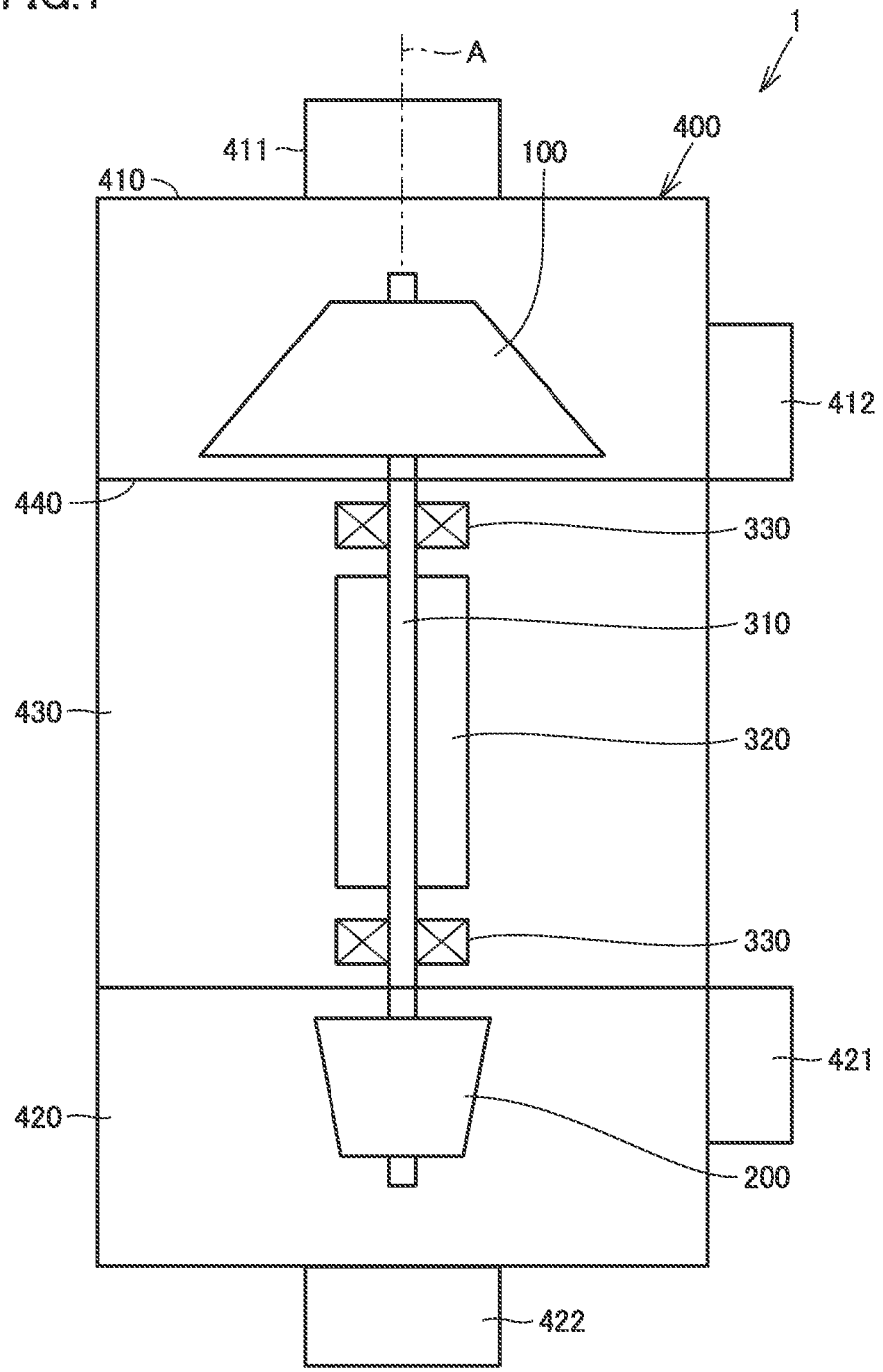
FIG. 1 is a diagram schematically showing a configuration of a centrifugal compressor according to an embodiment of the present invention.

FIG. 1 is a diagram schematically showing a configuration of a centrifugal compressor according to an embodiment of the present invention. As shown in FIG. 1, the centrifugal compressor 1 includes an impeller 100, a turbine wheel 200, a rotation shaft 310, a motor 320, a bearing 330, and a casing 400.

The rotation shaft 310 interconnects the impeller 100 and the turbine wheel 200. The rotation shaft 310 is rotationally driven by the motor 320. The rotation shaft 310 is received by the bearing 330. The motor 320 includes a rotor and a stator (not shown).

The casing 400 houses the impeller 100, the turbine wheel 200, the rotation shaft 310, the motor 320, and the bearing 330. The casing 400 has a compressor housing 410, a turbine housing 420, and a center housing 430.

The compressor housing 410 houses the impeller 100. The compressor housing 410 has a suction port 411 and a discharge unit 412. A diffuser (not shown) is provided in the compressor housing 410 on a discharging side of the impeller 100.

The turbine housing 420 houses the turbine wheel 200. The turbine housing 420 has a suction unit 421 and a discharge port 422.

The center housing 430 is disposed between the compressor housing 410 and the turbine housing 420. The center housing 430 houses the motor 320 and the bearing 330.

The center housing 430 has a rear housing 440. The rear housing 440 is provided between the impeller 100 and the bearing 330.

Figure 2:
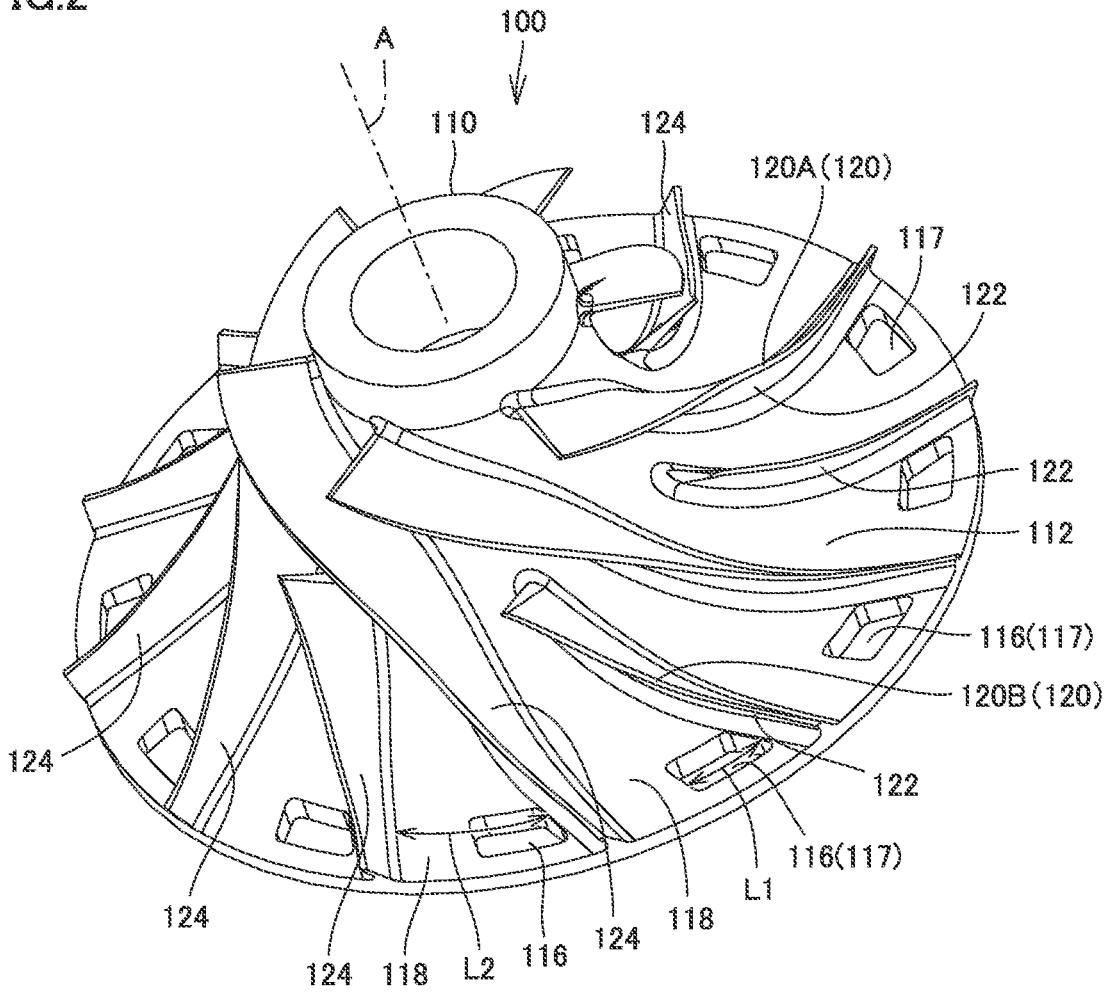
FIG. 2 is a perspective view of an impeller.
Figure 3:
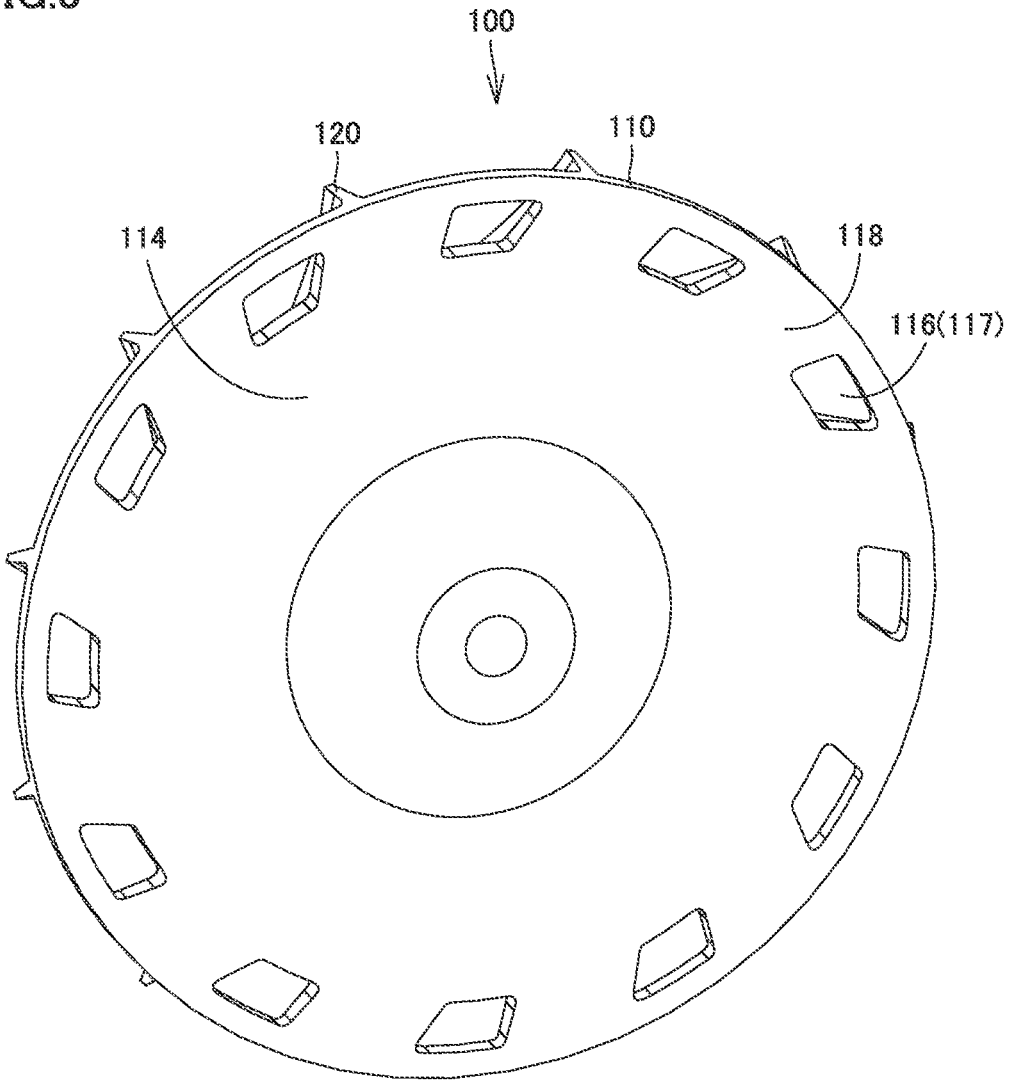
FIG. 3 is a perspective view of the impeller at an angle different from that in FIG. 2.

The impeller 100 receives gas (e.g., air) sucked through the suction port 411 and discharges the gas through the discharge unit 412. As shown in FIGS. 2 and 3, the impeller 100 includes a hub 110 and a plurality of blades 120.

The hub 110 is fixed to the rotation shaft 310 and is rotatable about the axis A. In the present embodiment, the axis A corresponds to an axis of center of rotation of the rotation shaft 310. The hub 110 has an external radial surface 112, a back surface 114, a portion 116 closer to a positive pressure surface, and a portion 118 closer to a negative pressure surface.

The external radial surface 112 has a shape increasing in diameter from one side (an upper side in FIG. 1) of the rotation shaft 310 toward the other side (a lower side in FIG. 1) of the rotation shaft 310. In other words, the external radial surface 112 has a shape having an outer diameter gradually increasing from an end portion on the suction side toward an end portion on the discharging side. As the external radial surface 112 extends from one side toward the other side, the external radial surface 112 has a shape curved to be convex in a direction approaching the rotation shaft 310.

The back surface 114 is orthogonal to the axis A. The back surface 114 is formed on the other side (or the discharging side). The back surface 114 is formed flat.

Each blade 120 is provided on the external radial surface 112 of the hub 110. Each blade 120 extends on the external radial surface 112 of the hub 110 from one side of the external radial surface 112 toward the other side of the external radial surface 112. Each blade 120 is tilted in a direction in which the hub 110 rotates. The plurality of blades 120 have a plurality of first blades 120A and a plurality of second blades 120B.

The first blade 120A has a shape extending from a vicinity of an end of the external radial surface 112 that is located on one side thereof to reach an end of the external radial surface 112 located on the other side thereof.

The second blade 120B has a shape extending from a radially middle portion of the external radial surface 112 to reach the end of the external radial surface 112 that is located on the other side thereof.

As shown in FIG. 2, each blade 120 has a positive pressure surface 122 and a negative pressure surface 124.

The positive pressure surface 122 is a surface of the blade 120 that is of positive pressure when the hub 110 rotates about the axis A.

The negative pressure surface 124 is a surface of the blade 120 that is of negative pressure when the hub 110 rotates about the axis A.

As shown in FIGS. 2 and 3, the hub 110 has an outer edge portion with a plurality of portions 116 each closer to a positive pressure surface and a plurality of portions 118 each closer to a negative pressure surface.

With reference to FIG. 2, a length L1 of the portion 116 closer to the positive pressure surface in a circumferential direction is set to be equal to or less than half of a distance L2 in the circumferential direction between a pair of blades 120 adjacent to each other. Each portion 116 closer to the positive pressure surface is preferably formed near a radially outer edge portion of the hub 110.

Each portion 118 closer to the negative pressure surface extends from each portion 116 closer to the positive pressure surface in the circumferential direction of the hub 110 and is also in contact with the negative pressure surface 124 of each blade 120.

The hub 110 has a lightening hole 117 that opens to the external radial surface 112 between the positive pressure surface 122 and the negative pressure surface 124 of the plurality of blades 120. In other words, the lightening hole 117 is provided at a portion of the external radial surface 112 of the hub 110 between the first blade 120A and the second blade 120B adjacent to each other in the circumferential direction. The lightening hole 117 is provided closer to the positive pressure surface 122 of the blade 120 than the negative pressure surface 124 of the blade 120. The lightening hole 117 is provided only at the portion 116 closer to the positive pressure surface. The lightening hole 117 is not provided at the portion 118 closer to the negative pressure surface. In the present embodiment, each lightening hole 117 is a through hole penetrating from the external radial surface 112 through to the back surface 114. That is, in the present embodiment, the lightening hole 117 is zero in thickness. The through hole penetrates the hub 110 in a direction parallel to the axis A.

When the centrifugal compressor 1 as described above is driven, a portion of the hub 110 near the discharging side and in contact with the negative pressure surface 124 of the blade 120 experiences a relatively high stress due to centrifugal force. The impeller 100 of the present embodiment ensures thickness for the portion 118 closer to the negative pressure surface that experiences a relatively high stress, and has the portion 116 closer to the positive pressure surface that experiences a relatively low stress set to be smaller in thickness than the portion 118 closer to the negative pressure surface, and thus coestablishes reduction in moment of inertia of the impeller 100 and suppression of uneven distribution of stress caused to the impeller 100.

For example, the blades 120 may all be shaped identically.

Manner

It will be appreciated by those skilled in the art that the above exemplary embodiment is a specific example of the following manner:

A centrifugal compressor according to an aspect of the present disclosure is a centrifugal compressor comprising a rotation shaft and an impeller fixed to the rotation shaft and rotating together with the rotation shaft, the impeller including a hub having an external radial surface having a shape gradually increasing in diameter from one side of the rotation shaft toward the other side of the rotation shaft and a back surface formed on the other side of the rotation shaft, and a plurality of blades provided on the external radial surface of the hub, the plurality of blades each having a positive pressure surface and a negative pressure surface extending from one side of the external radial surface toward the other side of the external radial surface, and being of a positive pressure and a negative pressure, respectively, when the impeller rotates, the hub having a lightening hole that opens to the external radial surface between the positive pressure surface and the negative pressure surface, the lightening hole being closer to the positive pressure surface of the blade than the negative pressure surface of the blade.

The present centrifugal compressor comprises an impeller such that a portion of a hub located on the side of positive pressure and thus experiencing a relatively low stress is smaller in thickness than a portion of the hub located on the side of negative pressure and thus experiencing a relatively high stress, and thus coestablishes reduction in moment of inertia of the impeller and suppression of uneven distribution of stress caused to the impeller.

Further, the lightening hole is preferably a through hole penetrating from the external radial surface through to the back surface.

In this manner, the impeller's moment of inertia is further reduced, and a thrust load acting on the impeller when the impeller rotates is also reduced.

Further, a length of each lightening hole of the hub in the circumferential direction thereof is preferably equal to or less than half of a length of the positive pressure surface and the negative pressure surface in the circumferential direction.

Preferably, the blade has a first blade extending from one side of the external radial surface to the other side of the external radial surface and a second blade extending from a radially middle portion of the external radial surface toward the other side of the external radial surface, and the lightening hole is provided closer to the positive pressure surface of the first blade than the negative pressure surface of the first blade and closer to the positive pressure surface of the second blade than the negative pressure surface of the second blade.

While the present invention has been described in embodiments, it should be understood that the embodiments disclosed herein are illustrative and non-restrictive in any respect. The scope of the present invention is defined by the terms of the claims, and is intended to include any modifications within the meaning and scope equivalent to the terms of the claims.

What is claimed is:

1. A centrifugal compressor comprising a rotation shaft and an impeller fixed to the rotation shaft, the impeller including:

a hub having an external radial surface having a shape gradually increasing in diameter from a first side of the rotation shaft toward a second side of the rotation shaft, and a back surface formed on the second side of the rotation shaft, and a plurality of blades provided on the external radial surface of the hub, the plurality of blades each having a positive pressure surface and a negative pressure surface extending from a first one side of the external radial surface toward a second side of the external radial surface, and being of a positive pressure and a negative pressure, respectively, when the impeller rotates, the hub having a plurality of through holes that open to the external radial surface and penetrate from the external radial surface through to the back surface, the through holes being disposed at locations between adjacent blades of the plurality of blades, respectively, so as to be between the positive pressure surface of a first blade of the plurality of blades and the negative pressure surface of a second blade of the plurality of blades, the hub having an outer edge portion with a plurality of first portions each closer to the positive pressure surface and a plurality of second portions each closer to the negative pressure surface, the plurality of second portions extending from the plurality of first portions in a circumferential direction of the hub and being in contact with the negative pressure surface of a respective second blade, the through holes being provided only at the plurality of first portions, wherein the through holes are each in contact with the positive pressure surface of a respective first blade and elongated on the external radial surface in the circumferential direction of the hub, and wherein an end portion of the through holes that is in contact with the positive pressure surface of the respective first blade conforms to a contour of the positive pressure surface of the respective first blade.

2. The centrifugal compressor according to claim 1, wherein a length of each through hole is equal to approximately half of a length between the adjacent blades in the circumferential direction of the hub.

3. The centrifugal compressor according to claim 1, wherein each of the first blades extends from a radially inner portion of the external radial surface toward the second side of the external radial surface, and each of the second blades extends from a radially middle portion of the external radial surface toward the second side of the external radial surface.

* * * * *